US010925359B1

(12) United States Patent
Smith

(10) Patent No.: US 10,925,359 B1
(45) Date of Patent: Feb. 23, 2021

(54) ROOFING WALKING STICK

(71) Applicant: Hope Marcelle Smith, Sierra Vista, AZ (US)

(72) Inventor: Hope Marcelle Smith, Sierra Vista, AZ (US)

( * ) Notice: Subject to any disclaimer, the term of this patent is extended or adjusted under 35 U.S.C. 154(b) by 0 days.

(21) Appl. No.: 16/595,467

(22) Filed: Oct. 8, 2019

(51) Int. Cl.
*A45B 9/04* (2006.01)

(52) U.S. Cl.
CPC ..... *A45B 9/04* (2013.01)

(58) Field of Classification Search
CPC ..... A45B 9/04
See application file for complete search history.

(56) References Cited

U.S. PATENT DOCUMENTS 2,453,742 A * 11/1948 Bowen ..... A61H 3/0288 135/77
4,440,186 A * 4/1984 Lottner ..... A45B 9/04 135/84
4,510,957 A * 4/1985 Frank ..... A45B 9/04 135/79
4,899,771 A * 2/1990 Wilkinson ..... A45B 9/04 135/77
5,492,141 A * 2/1996 Oberlander ..... A62B 35/0056 135/65
7,047,990 B2 * 5/2006 Zambrano ..... A45B 1/00 135/82
7,581,556 B2 * 9/2009 Haslach, Jr. ..... A45B 1/00 135/77
7,607,192 B2 * 10/2009 Flora ..... A47L 13/20 15/209.1
7,686,025 B1 * 3/2010 Dowling ..... A45B 9/04 135/66
7,895,700 B2 * 3/2011 Tanaka ..... A47L 13/256 15/231
8,434,790 B2 5/2013 Lenhart
9,084,458 B2 7/2015 Crowhurst
9,226,556 B1 * 1/2016 Chien ..... A61H 3/0288
(Continued)

FOREIGN PATENT DOCUMENTS

DE 4108834 A1 * 9/1992 ..... A45B 9/04
JP 200610254 A 4/2006
(Continued)

*Primary Examiner* — Noah Chandler Hawk
(74) *Attorney, Agent, or Firm* — Richard Eldredge; Eldredge Law Frim

(57) ABSTRACT

A walking stick and a method of its use are described. A broad, flat, rigid base with a non-slip material adhered and/or affixed to the broad, flat, rigid base that extends out from a pivoting point. This pivoting point rotates 180 degrees around each of the three geometric axes, X, Y and Z. The broad, flat, rigid base can thus adjust to any angle in any direction, allowing it to conform upon contact and to lay flat against a sloped surface such as a pitched roof. A handle/support extends up from the pivoting point. A walker holds, controls and moves the roofing walking stick using the handle/support. With each movement, the broad, flat, rigid base with non-slip material adhered and/or affixed to the broad, flat, rigid base conforms upon contact and lays flat against the sloped surface giving the walker who is controlling the handle/support stability and traction while negotiating even a steep sloped surface such as the pitched roof of a structure.

1 Claim, 4 Drawing Sheets

(56) References Cited

U.S. PATENT DOCUMENTS

| | | | | |
|---|---|---|---|---|
| 9,326,572 | B2 | 5/2016 | Daily | |
| 9,456,671 | B2 * | 10/2016 | Crowhurst | A45B 9/04 |
| 2017/0280961 | A1 * | 10/2017 | Pellegrino | A46B 5/0095 |

FOREIGN PATENT DOCUMENTS

| | | | |
|---|---|---|---|
| JP | 31689534 | | 7/2011 |
| JP | 2013166073 | A | 8/2013 |

* cited by examiner

ROOFING WALKING STICK

CROSS-REFERENCE TO RELATED APPLICATIONS

This application claims the benefit of provisional patent application Ser. No. 67/742,452 filed 2018 Oct. 8 by the present inventor.

PRIOR ART

The following is a tabulation of some prior art that presently appears relevant:

| U.S. Pats. | | | |
|---|---|---|---|
| Pat. No. | Kind Code | Issue Date | Inventor |
| 9,084,458 | B2 | 2015 Jul. 21 | Crowhurst |
| 9,326,572 | B2 | 2016 May 3 | Daily |
| 8,434,790 | B2 | 2013 May 7 | Lenhart |
| **Foreign Patent Documents** | | | |
| Foreign Doc. No. | Country Code | Pub. Date | Inventor |
| 3168953U | JP | 2011 Jul. 7 | 金章 呉金章 呉 |
| 2006102054A | JP | 2006 Apr. 20 | Hayashi |
| 2013166073A | JP | 2013 Aug. 29 | Nishimura |

TECHNICAL FIELD

Some implementations relate generally to stability/mobility aids, and more particularly to walking sticks.

BACKGROUND

Many people, roofers, home inspectors, homeowners, etc., walk on pitched roofs of structures. Pitched roofs can be perilous and difficult to balance on and to navigate when walking.

There may be a need to provide an aid which creates stability for the walker when navigating a pitched roof.

Safety devices on roofs have primarily focused on fall prevention or lessening injury from a fall. These devices include things like rope and harness systems, roof ladders with ridge hooks, roof jacks with support beams, etc.

All of these, while very useful for safety, can be cumbersome, complicated, difficult to maneuver with and sometimes even result in physical damage to the roofing material.

While the roofing walking stick can also prevent falls, the main focus is in providing balance and maneuverability for a walker, and its use is very convenient and easy.

Traditional walking sticks are designed with little or no movement at the base of the stick. This is because walking sticks are designed for stability as a person who has difficulty walking walks on a relatively level surface or a surface with only slight terrain variations or a slight angle.

The roofing walking stick is designed for a walker to navigate a steep sloped surface. Its rotating base allows for this. A pivotal joint between a handle/support and a broad, flat, rigid base allows the broad, flat, rigid base of the roofing walking stick to match (parallel) the angle of the traversed surface and to conform to and lay flat against the slope Several types of walking sticks have been proposed, for example, U.S. Pat. Nos. 9,084,458, 9,326,572, JP3168953U, JP2006102054A and JP2013166073A, which offer some play in the angle of the base by various means, such as a spring, a "bendable puck", etc., thus creating a slight tilt to the base to accommodate small variations in terrain angles; however, each are limited to angles of approximately 20 degrees or less and do not accommodate steep slopes with angles higher than 20 degrees.

OSHA defines a "steep roof" as any roof with a rise/run ratio over 4:12 (18.43 degrees). Roofing ratios increase from there up to a common rise/run ratio of 12:12 (45 degrees) and even higher.

In addition, these walking sticks listed have bases with relatively small tips, approximately 1" in diameter, or have more than one tip (i.e. three or four tips), each approximately 1" in diameter which "dig in" to the terrain being walked upon in order to provide traction. Such bases place a large amount of pressure onto the surface they contact; thus, if used on a fragile surface, such as roofing material, they would cause deformation and damage.

U.S. Pat. No. 8,434,790 for a ski pole tip adaption provides a rotatable joint at the base to accommodate mountain terrain and is designed to dig into snow-covered terrain. It thus presents the same problem as above in that it is designed to put considerable pressure on the substance (snow) beneath it at intermittent intervals when used as a balance for a skier in motion.

Since pressure equals force divided by area, a small area like the base of the above-mentioned walking sticks exert great pressure on the surface beneath. If a person is using such a walking stick, it can mar a fragile surface.

Using the above formula, doubling the size of the base would result in half the pressure. Following this pattern, the enlarged base of the roofing walking stick results in exponentially less pressure being exerted. The current preferred area of the broad, flat, rigid base of the proposed implementation is approximately 1' by 1'; however, variations in size and shape are anticipated and the Applicant intends to embrace all such alternatives.

The base of the roofing walking stick disperses the pressure in such a way as to allow a person to use the device without damaging the material beneath it, material such as roofing shingles, cement roofing tiles, ceramic roofing tiles or wooden shake roofing, to name a few.

This is essential for professionals or homeowners alike who are walking on, inspecting or working on roofs and do not want to damage the roofing material and potentially compromise the water-shedding integrity of the roof.

This non-damaging benefit may also be enhanced by using a compressible non-slip material on the base such as high-density foam.

In addition, the broad, flat base of the roofing walking stick provides for more surface area of the non-slip material to be in contact with the traversed surface beneath; thus, resulting in a greater amount of traction for the walker.

SUMMARY

The roofing walking stick includes a broad, flat, rigid base with a non-slip material adhered and/or affixed to the broad, flat, rigid base.

The broad, flat, rigid base extends out from a pivoting point.

The broad, flat, rigid base rotates 180 degrees from the pivoting point around each of the three geometric axes, X, Y and Z.

Thus, the broad, flat, rigid base can adjust to any angle in any direction, allowing it to conform upon contact and to lay flat against a sloped surface such as a pitched roof.

A handle/support extends up from the pivoting point.

A walker holds, controls and moves the roofing walking stick using the handle/support.

The broad, flat, rigid base with the non-slip material adhered and/or affixed to the broad, flat, rigid base conforms upon contact and lays flat against the sloped surface giving the walker who is controlling the handle/support stability and traction while navigating even a steep sloped surface such as the pitched roof of a structure.

DETAILED DESCRIPTION

Figure 1:
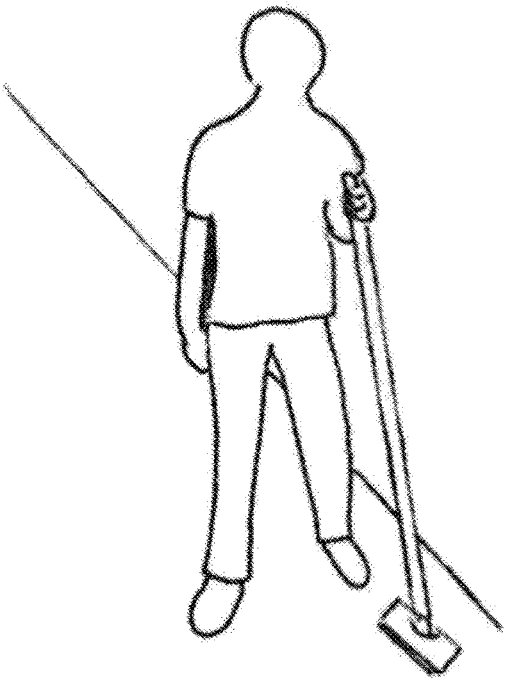
FIG. 1, FIG. 2, and FIG. 3 are examples of the roofing walking stick in use in accordance with some implementations.

FIG. 1 depicts a walker holding and using the roofing walking stick to navigate on a steep sloped surface. The roofing walking stick is a mobility aid and provides stability to the walker.

Figure 2:
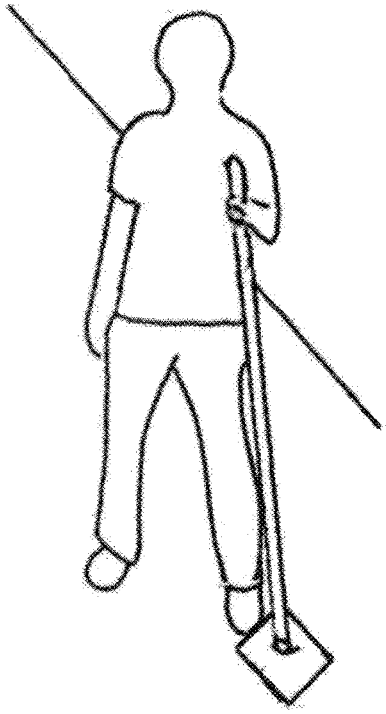

FIG. 2 depicts a walker with the roofing walking stick positioned in a slightly different location than FIG. 1, demonstrating the ability of the walker to move and relocate the roofing walking stick to another location on the sloped surface, thus assisting in mobility and providing stability to the walker.

Figure 3:
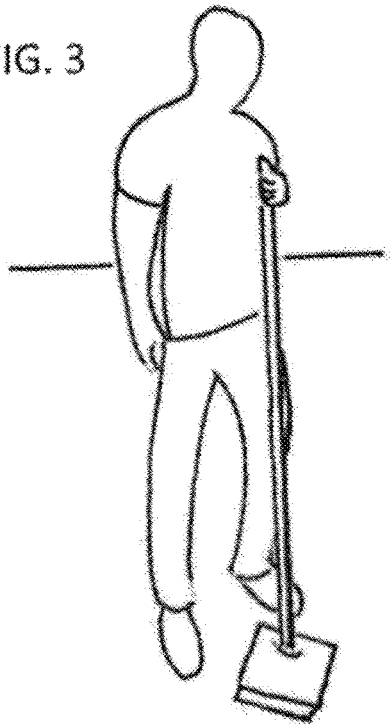

FIG. 3 depicts a walker with the roofing walking stick positioned in a slightly different location than FIG. 2, demonstrating the ability of the walker to move and relocate the roofing walking stick to another location on the sloped surface, thus assisting in mobility and providing stability to the walker.

Figure 4:
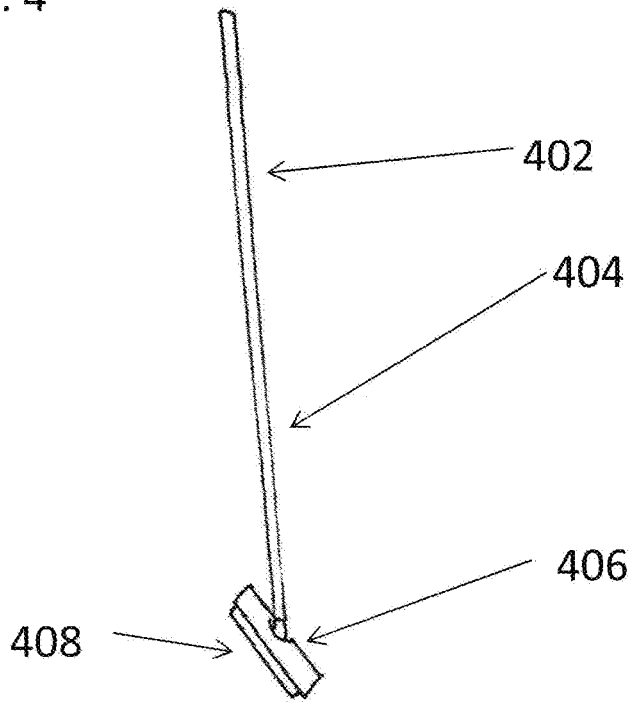
FIG. 4 is an example of the components of the roofing walking stick

FIG. 4 is a diagram of an example of the roofing walking stick and its components. The roofing walking stick includes a handle/support 402, a pivoting point 404, a broad, flat, rigid base 406 and a non-slip material 408.

The handle/support 402 extends up from the pivoting point, and a walker holds, controls and moves the roofing walking stick using the handle/support.

The pivoting point 404 allows for 180-degree rotation around each of the three geometric axes, X, Y and Z.

The broad, flat, rigid base 406 with the non-slip material adhered and or/affixed to the broad, flat, rigid base conforms upon contact and lays flat against the sloped surface such as a pitched roof providing traction against the sloped surface.

Figure 5:
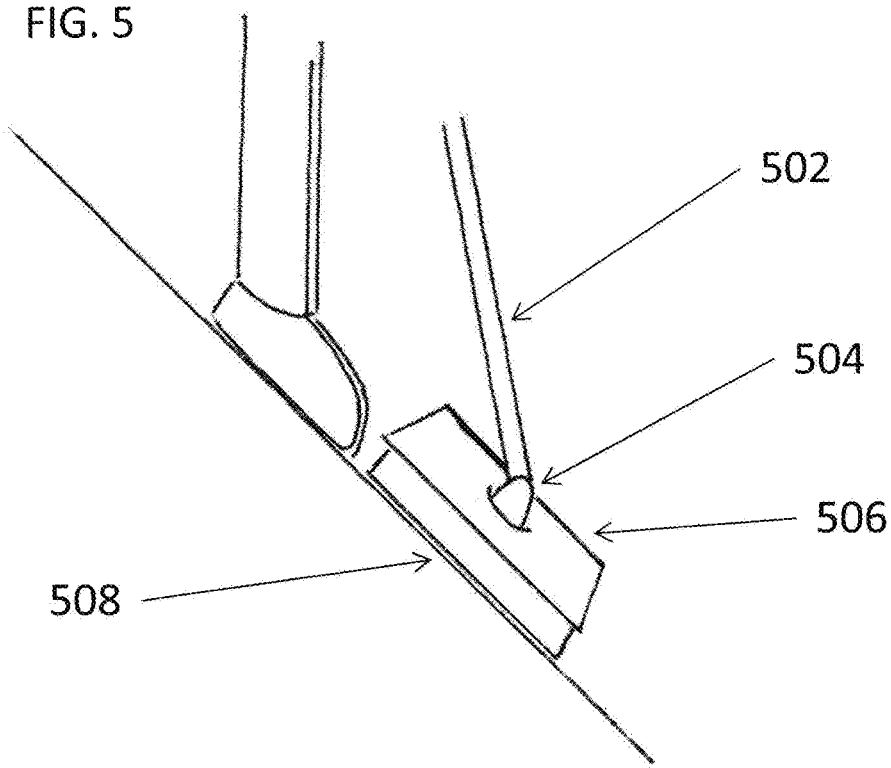
FIG. 5 is a close-up of the components of the roofing walking stick.

FIG. 5 is a close-up view of the example diagram of the roofing walking stick providing a closer view of the elements of the roofing walking stick: the handle/support 502, the pivoting point 504 and the broad, flat, rigid base 506 and the non-slip material 508.

Figure 6:
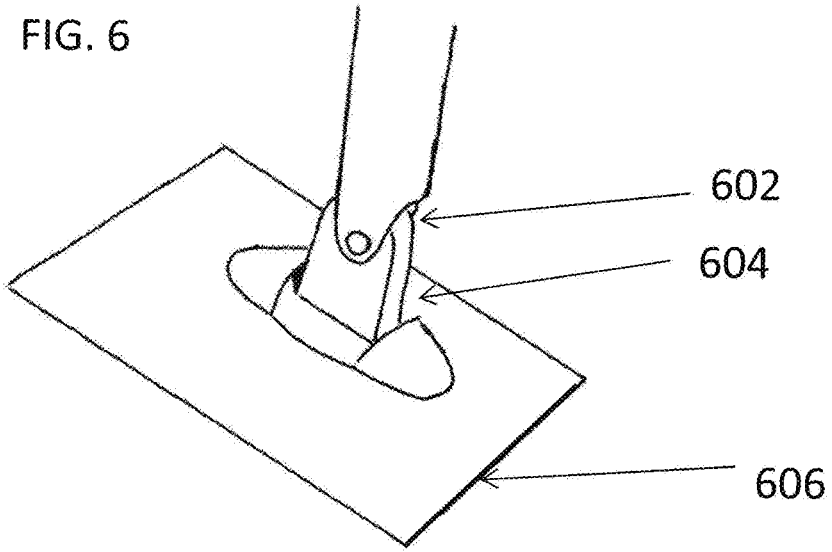
FIG. 6 illustrates a close-up view of two perpendicular hinges.

FIG. 6 illustrates a close-up view of two perpendicular hinges, the current preferred pivotal means; however, other alternatives would provide the same range of motion and the Applicant intends to embrace all such alternatives. The illustration shows hinge one 602, hinge two 604 and the broad, flat, rigid base 606.

Figure 7:
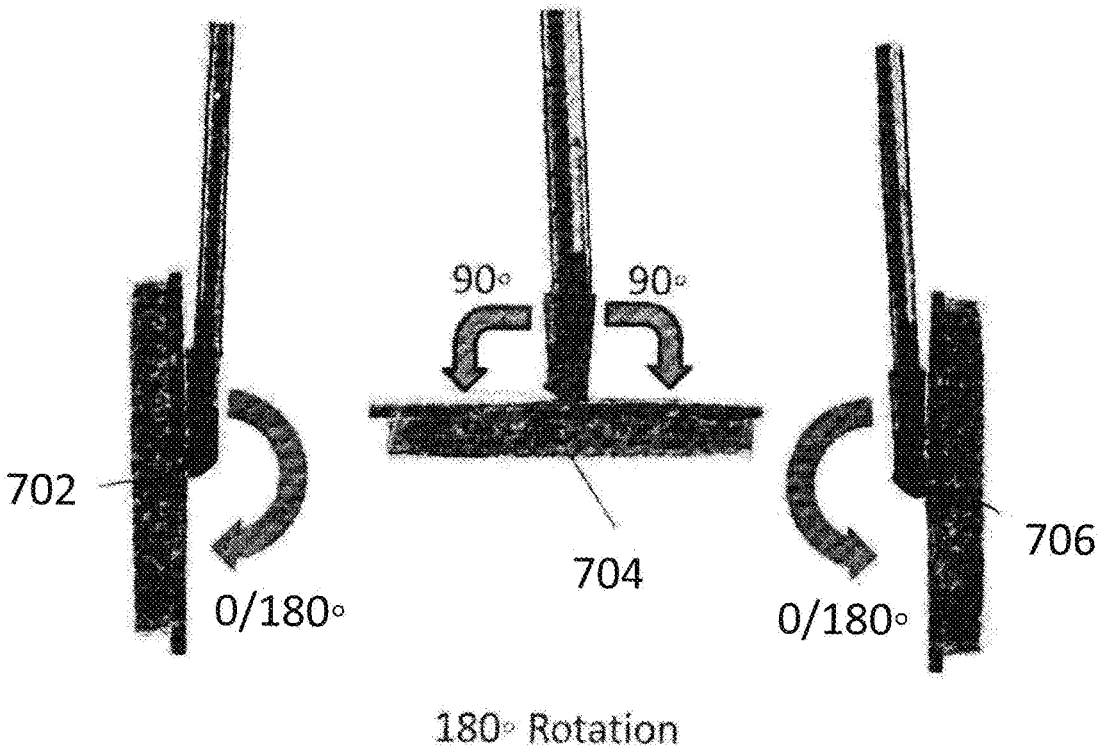
FIG. 7 illustrates the rotation of the broad, flat, rigid base around the pivoting point.

FIG. 7 illustrates the 180-degree rotation of the broad, flat, rigid base around the pivoting point.

702 depicts the broad, flat, rigid base at a 0/180-degree angle from the respective sides of the handle/support.

704 depicts the broad, flat, rigid base at a 90/90-degree angle from the respective sides of the handle/support.

706 depicts the broad, flat, rigid base at a 0/180 degree angle from the respective sides of the handle/support.

Figure 8:
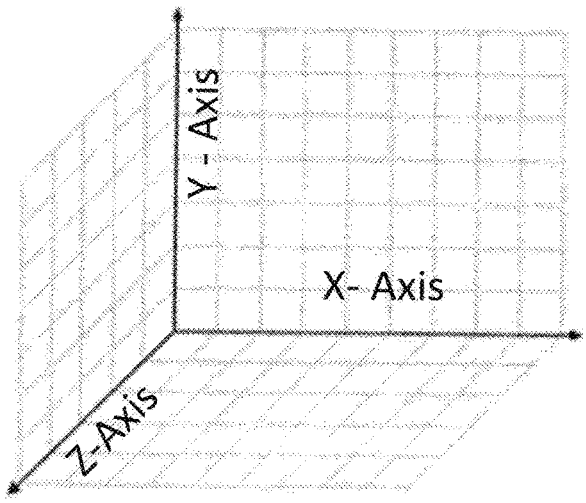
FIG. 8 illustrates the geometric axes.

FIG. 8 is an illustration used to show the perspective of the three spatial dimensions/geometric axes, height, width and depth, using the X, Y, and Z coordinates.

Figure 9:
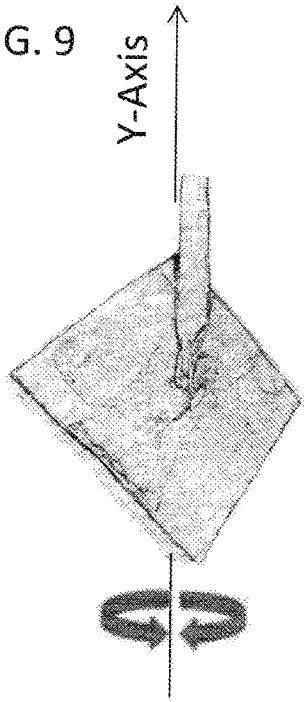
FIG. 9 illustrates rotation around the Y-axis.
Figure 10:
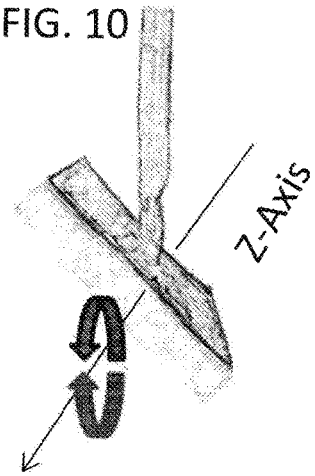
FIG. 10 illustrates rotation around the Z-axis.
Figure 11:
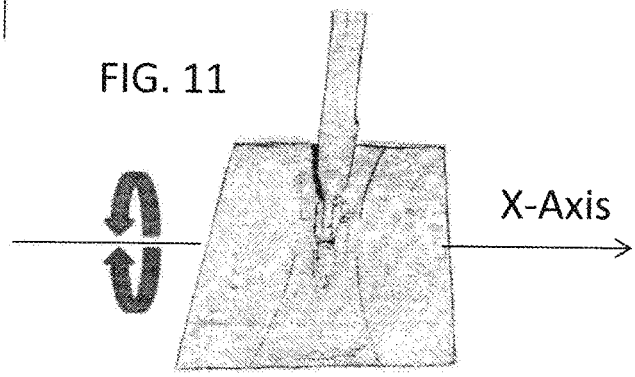
FIG. 11 illustrates rotation around the X-axis.

FIG. 9 illustrates the 180-degree rotation of the broad, flat, rigid base from the pivoting point around the Y-axis FIG. 10 illustrates the 180-degree rotation of the broad, flat, rigid base from the pivoting point around the Z-axis FIG. 11 illustrates the 180-degree rotation of the broad, flat, rigid base from the pivoting point around the X-axis While the disclosed subject matter has been described in conjunction with a number of embodiments, it is evident that many alternatives, modifications and variations would be, or are, apparent to those of ordinary skill in the applicable arts. Accordingly, Applicant intends to embrace all such alternatives, modifications, equivalents and variations that are within the spirit and scope of the disclosed subject matter.

I claim:

1. A method of providing stability for a walker navigating a sloped surface such as a pitched roof, the method comprising:

providing a walking stick having;

a handle of a predetermined length;

a base secured to the handle and having a top surface and a bottom surface;

a high-density foam material secured to the bottom surface; and a pivot device secured to the top surface of the base, the pivot device is configured to pivot the base relative to the handle, thereby allowing the base to match the angle of a sloped surface, whereby providing stabilization for walking on the sloped surface a walker controlling and moving the walking stick by holding onto the handle/support, lifting and relocating the base with the high-density foam onto another area of the sloped surface so that the base with the high-density foam conforms to and lays flat against the sloped surface thereby providing stability and traction while the walker navigates the sloped surface.

* * * * *